US005207266A

United States Patent [19]

Nakashima et al.

[11] Patent Number: 5,207,266

[45] Date of Patent: May 4, 1993

[54] WATER-COOLED COPPER CASTING MOLD

[75] Inventors: Kunio Nakashima; Ryoichi Ishigane; Takayuki Tanaka; Kenzo Yamamoto, all of Toyama, Japan

[73] Assignee: Chuetsu Metal Works Co., Ltd., Toyama, Japan

[21] Appl. No.: 816,820

[22] Filed: Jan. 3, 1992

[51] Int. Cl.[5] ..... B22D 11/124

[52] U.S. Cl. ..... 164/348; 164/443

[58] Field of Search ..... 164/348, 443, 418

[56] References Cited

U.S. PATENT DOCUMENTS 3,625,498 11/1968 Adamec ..... 164/443

5,117,895 6/1992 Hargassner et al. ..... 164/443

FOREIGN PATENT DOCUMENTS 57-49049 3/1982 Japan .

2-17732 5/1990 Japan .

*Primary Examiner*—Richard K. Seidel

*Assistant Examiner*—Erik R. Pukneys

*Attorney, Agent, or Firm*—Flynn, Thiel, Boutell & Tanis

[57] ABSTRACT

A water-cooled copper casting mold comprising a copper plate, a back frame which is fastened to the copper plate to thereby form cooling channels in which widths of main channels in the bolt fastening region are wider than those in other regions, characterized in that the water-cooled copper casting mold further comprises increased channels which are formed between right and left main channels in the bolt fastening region excluding bolt screwing halls, branch channels which are provided between the main channels and the increased channels wherein at least one of the branch channels and branching portions of the main channels has more sectional areas of water than the main and the increased channels.

2 Claims, 6 Drawing Sheets

WATER-COOLED COPPER CASTING MOLD

BACKGROUND OF THE INVENTION

1. Field of the Invention

The present invention relates to a water cooled-copper casting mold comprising a copper plate as a body of a casting mold and a back frame which is fastened to the copper plate, in which widths of main channels are wider than those in other regions.

2. Prior Art

A water-cooled copper casting mold of this type forms slits on a copper plate to which a back frame is fastened so that the slits serve as channels through which water flows. The channels are formed in parallel with one another each having one end serving as an inlet and the other end serving as an outlet.

Bolts are fastened at given intervals to prevent water from leaking from the channels. There was such a problem in the conventional structure that intervals between the slits at the bolt fastening regions X were wider than other regions Y since the formation of the channels were restricted due to the existance of the bolts, as illustrated in FIGS. 3 and 4. As a result, the cooling effect was deteriorated.

To solve this problem, there is proposed a means as illustrated in FIGS. 5 and 6, in which increased channels 2*b* are formed at the central portion between main channels 2*a* excluding bolt screwing holes 5*a* and branch channels 2*d* are provided between the main channels 2*a* and the increased channels 2*b*. However, the mere increase of the slits increase sectional areas of the channels but reduce the velocity of a running cooled water (hereinafter referred to as water velocity), which results in reduction of the cooling effect (detail will be described later with reference to FIGS. 7 to 13).

SUMMARY OF THE INVENTION

It is therefore an object of the present invention to solve the problems set forth above and to provide a cooled-water copper casting mold having increased channels which are provided between main channels and branch channels which are provided between the main channels and the increased channels so that the cooling effect in the bolt fastening region is uniformly increased.

To achieve the above object, the cooled-water copper casting mold according to the present invention comprises a copper plate, a back frame which is fastened to the copper plate to thereby form cooling channels in which widths of main channels in the bolt fastening region are wider than those in other regions, characterized in that the cooled-water copper casting mold further comprises increased channels which are formed between right and left main channels in the bolt fastening region excluding bolt screwing holes, branch channels which are provided between the main channels and the increased channels wherein at least one of the branch channels and branching portions of the main channels has more sectional areas of water than the main and the increased channels.

When the cooling water is introduced into one end of the main channel, the cooling water flows into the main channel and the increased channel. At any time, the cooling water is discharged from the other end of the main channel. However, if many sectional areas are provided in the branch channel and the branching portion, the resistance of the running water is reduced at the sectional areas, which increases the water velocity in the main channel and the increased channel.

The increase of the sectional areas of the channels depends on the width and depth of the slit. If the depth of the branch channels and the branching portions exceeds two times the main channels and the increased channels, the energy loss due to the branching and merging of the cooling water is increased, which entails the reduction of the water velocity increase effect. If the depth is further increased, it reduces the effective thickness of the casting mold. Regarding the width of the branch channel and branching portions, if they exceed three times the width of the main channels and the increased channels, the water velocity effect is reduced due to the branching and merging of the cooling water so that the running of water is liable to standstill, i.e. in saturating state.

Accordingly, it is preferable that the sectional areas of the branch channels and the branching portions in the widths thereof are increased one to three times as large as those of the main channels and the increased channels and/or the sectional areas of the branch channels and the branching portions in the depths thereof are increased one to two times as large as those of the main channels and the increased channels.

PREFERRED EMBODIMENT OF THE INVENTION

Figure 1:
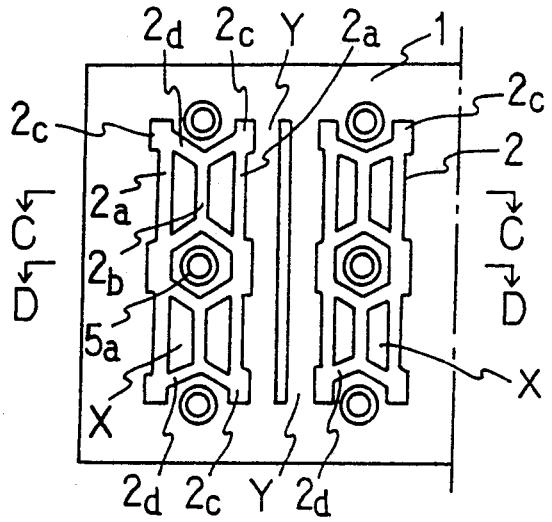
FIG. 1 is a plan view of a copper casting mold having many slits formed thereon according to the present invention.
Figure 2:
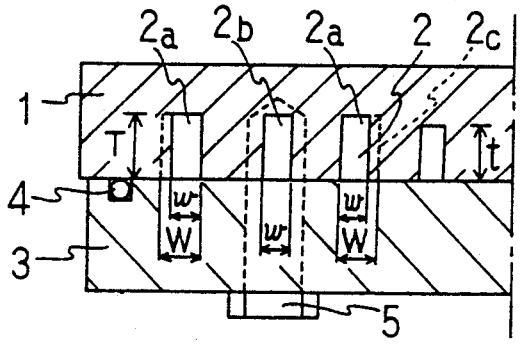
FIG. 2 is an enlarged cross-sectional view taken along arrows C—C (dotted lines taken along D—D) of FIG. 1.

First Embodiment (FIGS. 1 and 2)

A water-cooled copper casting mold according to a preferred embodiment of the present invention will be described with reference to FIGS. 1 and 2 in which FIG. 1 shows a plan view explaining the formation of the slit 2 on the copper plate 1 and FIG. 2 is a cross-sectional view taken along the arrows C—C of FIG. 1 and the portion taken along the arrows D—D is illustrated by dotted lines.

The water-cooled copper casting mold comprises the copper plate 1 having the slits 2 which are provided inside thereof and a back frame 3 is fastened by the bolt 5 at the inside of the copper plate 1. An O-ring 4 is interposed between the copper plate 1 and the back frame 3 for preventing the water from leaking therefrom. Three bolts 5 are arranged vertically in each column and each column is disposed in parallel with each other at a given spaced interval. The space in each column is called as a bolt fastening region X and the space between each column is called as another region Y.

In the region X, the main channels 2*a*, 2*a* are provided so as to interpose the bolt screwing holes 5*a*, 5*a*, 5*a* therebetween and the branching portions 2*c* are formed widely at both ends and the central portions of the main channels 2*a*, 2*a*, i.e. at the portions close to the bolt screwing holes 5*a*. Increased channels 2*b* are provided at the central portion between the main channels 2*a* and 2*a* and between the adjoining bolt screwing holes 5*a* and 5*a* and extend disposed in parallel with the main channels 2*a*. Branch channels 2*d* extend from the branching portion 2*c* to the increased channels 2*b* and have deep thickness.

Supposing that the channel width of the main channels 2*a* and the increased channels 2*b* are represented as w and the channel widths of the branching portion 2*c* and the branch channels 2*d* are represented as W, W is from one to three times as large as w. Supposing that the depths of the main channels 2*a* and the increased channels 2*b* are represented as t and those of the branching portions 2*c* and the branch channels 2*d* are represented as T, T is from one to two times as large as small t.

Second Embodiment (FIGS. 9 to 13)

Figure 3:
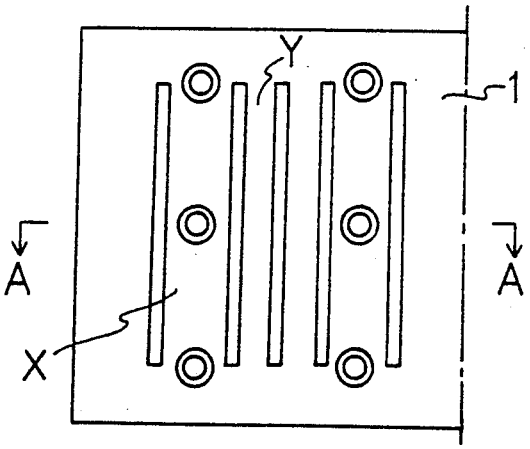
FIG 3 PRIOR ART
FIG. 3 is a plan view of a conventional copper casting mold, which corresponds to FIG. 1.
Figure 4:
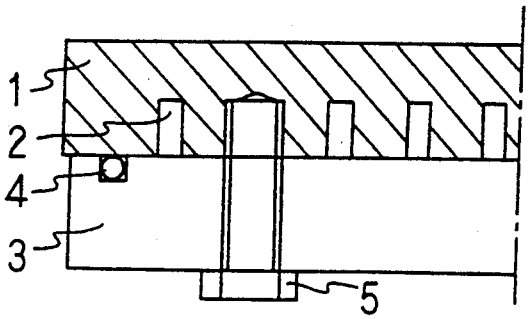
FIG 4 PRIOR ART
FIG. 4 is an enlarged cross-sectional view of the copper casting mold taken along arrows A—A of FIG. 3, which corresponds to FIG. 2.
Figure 5:
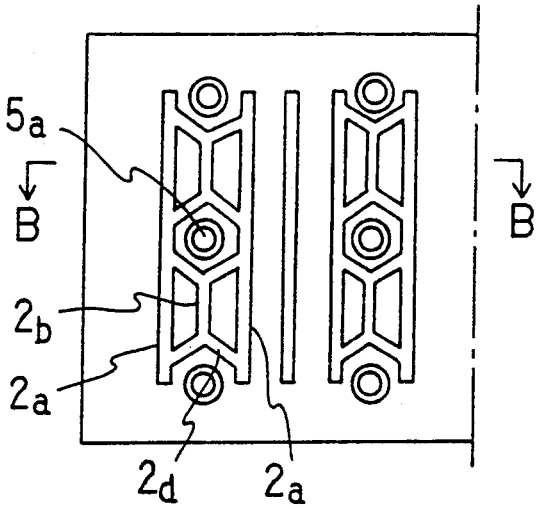
FIG. 5 is a plan view of the copper casting mold having increased slits, which is a reference view of FIG. 1.
Figure 6:
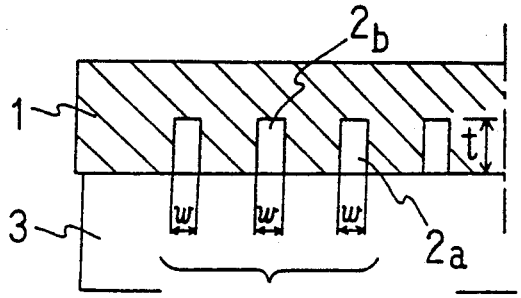
FIG. 6 is a cross-sectional view of the copper casting mold taken along arrows B—B of FIG. 5.
Figure 9:
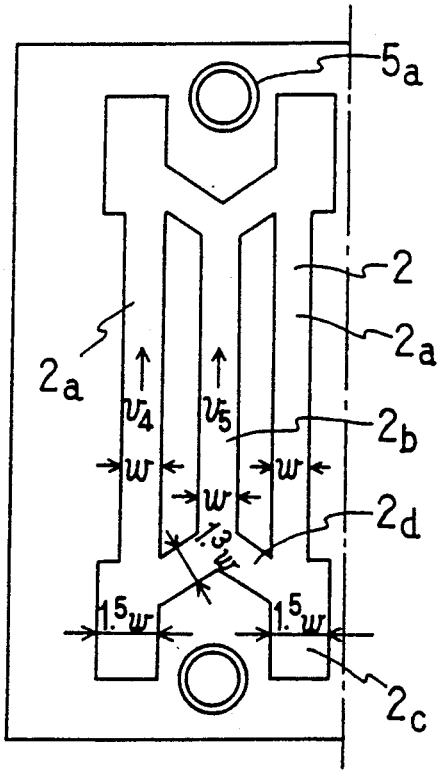
FIG. 9 is a plan view of a copper plate according to another embodiment of the present invention.

Although the basic pattern of the casting mold having three bolts 5 in one column according to the first embodiment is illustrated in FIGS. 1 and 2 which correspond to FIGS. 3 and 5, the basic pattern of the casting mold having two bolts 5 in one column is illustrated in FIG. 9 according to a second embodiment of the present invention.

Figure 7:
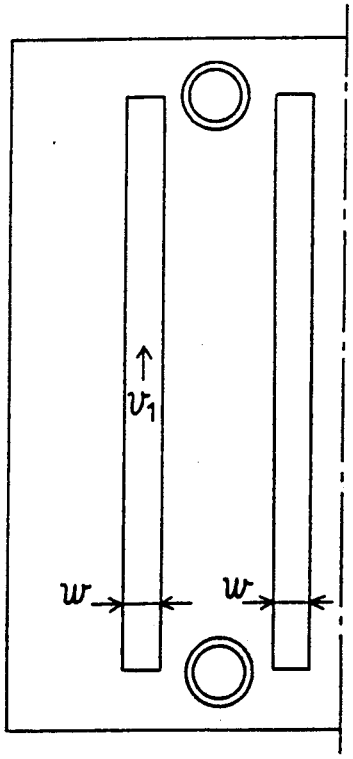
FIG 7 PRIOR ART
FIG. 7 is a plan view showing a conventional copper casting mold.
Figure 8:
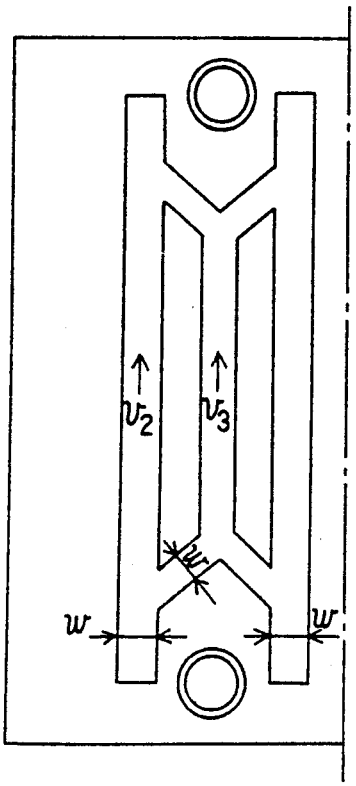
FIG. 8 is a plan view of a nonpractical copper casting mold, which is a reference view of FIG. 5.

A water-cooled copper casting mold according to the second embodiment in FIG. 9 corresponds to that of the first embodiment as illustrated in FIG. 1. Illustrated in FIG. 7 is a conventional reference embodiment, which corresponds to the conventional arrangement as illustrated in FIG. 3, and in FIG. 8 is a nonpractical embodiment equipped with more slits, which corresponds to the conventional arrangement as illustrated in FIG. 5. In these figures, there are represented the slit widths W and w, and the positions ($v_1$ to $v_5$) where the velocities are measured. Arrows represented over the positions $v_1$ to $v_5$ show running directions of the cooling water. Depths of the slits are same in each casting mold.

Figure 10:
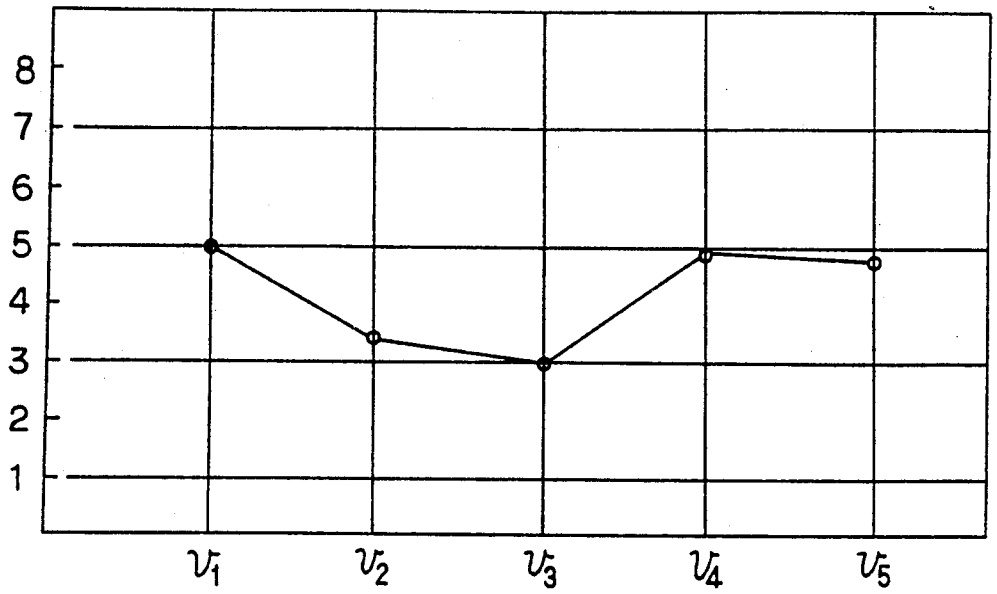
FIG. 10 is a graph showing a running velocity of cooling water in FIGS. 7, 8 and 9.

FIG. 10 shows measured values of the water velocities $v_1$ to $v_5$ measured in each casting mold. In the nonpractical example as illustrated in FIG. 8, the speeds of running water $v_2$ and $v_3$ is 3.5 m/sec and 3.0 m/sec, which entails sixty to seventy percent reduction of the water velocity compared with the water velocity at the position $v_1$ in the conventional casting mold as illustrated in FIG. 7.

According to the cooled-water copper casting mold according to the second embodiment as illustrated in FIG. 9, the speeds of running water at the position of $v_4$ and $v_5$ are 5 m/sec and 4.9 m/sec which is substantially same as those in the conventional casting mold as illustrated in FIG. 7.

Figure 11:
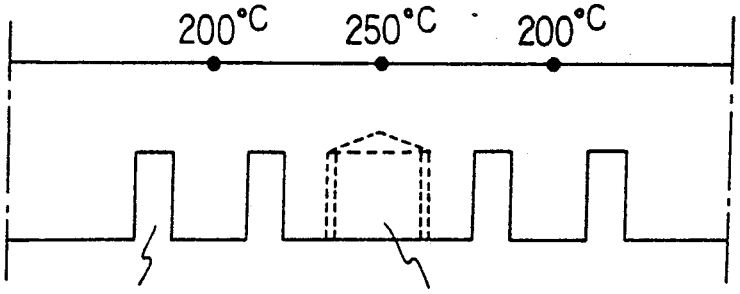
FIG 11 PRIOR ART
FIG. 11 is a cross-sectional view of FIG. 7, which shows a temperature distribution.
Figure 12:
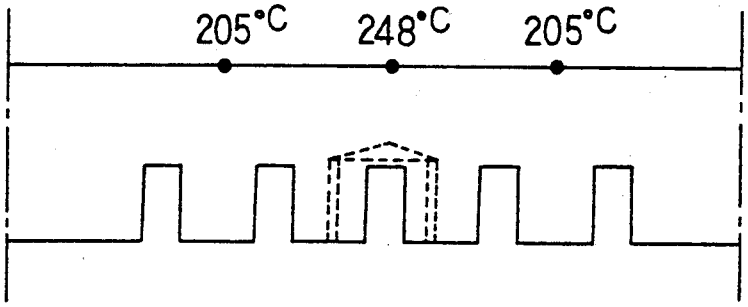
FIG. 12 is a cross-sectional view of FIG. 8, which shows a temperature distribution.
Figure 13:
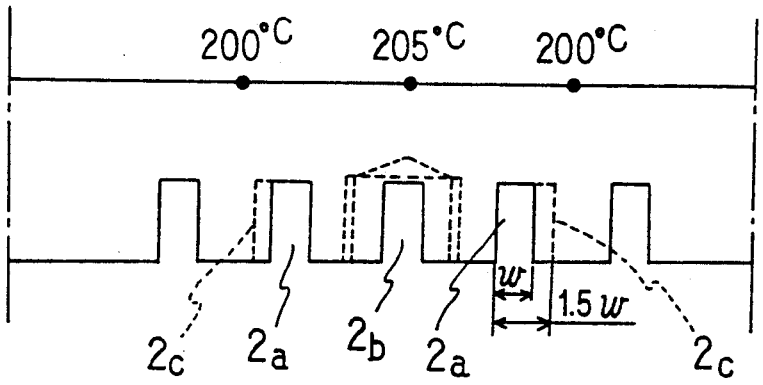
FIG. 13 is a cross-sectional view of FIG. 9, which shows a temperature distribution.

Cooling effect of the second embodiment will be described in more detail with reference to FIGS. 11 to 13, which correspond to each cross-sectional view of FIGS. 7 to 9. The casting mold condition is that the casting mold speed in 200 cm/min and the temperature of the cooling water is 35° C. FIG. 11 shows a conventional casting mold, FIG. 12 shows a nonpractical casting mold which increases branch slits and FIG. 13 is the casting mold according to the second embodiment of the present invention, in which temperature distribution have been illustrated based on the measured casting mold temperature at casting. According to the conventional casting mold, the temperature on the surface of the casting mold ranges from 200° C. to 250° C. which has the temperature difference of 50° C. while the temperature on the surface of the nonpractical casting mold which merely increases the branch slits thereof ranges from 205° C. to 248° C. On the other hand, according to the embodiment of the present invention, it ranges from 200° C. to 205° C. This means that it is important to widen the slit width of the portion where the slits are increased, or deepen the depths thereof properly and maintain the speed of cooling water.

Figure 14:
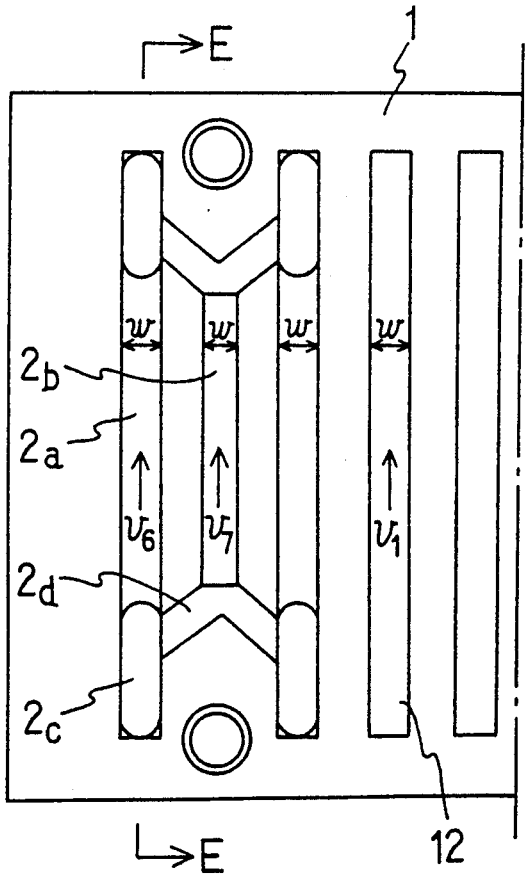
FIG. 14 is a plan view showing still other embodiment of the present invention.
Figure 15:
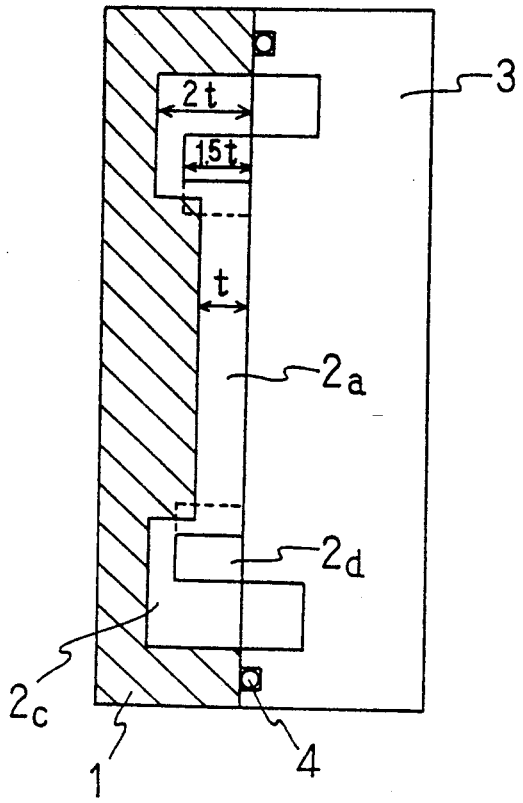
FIG. 15 is a cross-sectional view taken along E—E of FIG. 14.
Figure 16:
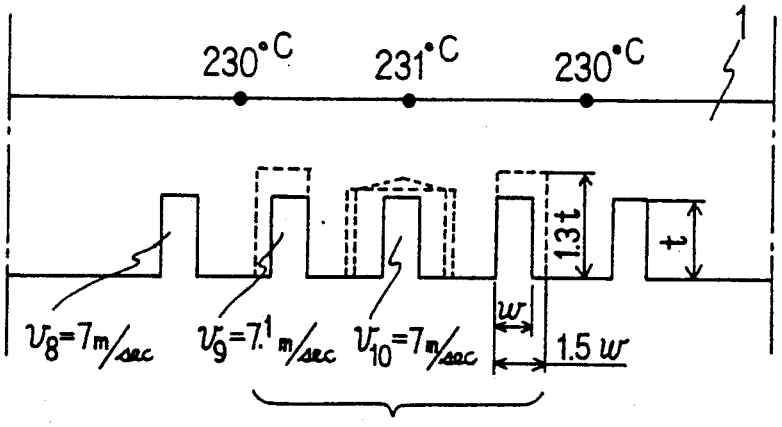
FIG. 16 is a cross sectional view of the copper casting mold according to still other embodiment.

Third Embodiment (FIGS. 14 to 16)

A water-cooled copper casting mold according to a third embodiment will be described with reference to FIGS. 14 to 16. In this embodiment, the depths of the branching portions 2*c* are two times as large as those of the main channels 2*a* and the increased channels 2*b* while the depths of the branch channels are 1.5 times as large as those of the main channels 2*a* and the increased channels 2*b*. However, the widths of the slits are same therebetween. According to the arrangement of the third embodiment, the water velocities $v_6$ and $v_7$ are 5.1 cm/sec and 5.0 cm/sec which are substantially same as the velocity $v_1$ in the main channel 12 which has not the increased branch slits.

In the arrangement in FIG. 16, the depths and the widths of the branch channels 2*d* and the branching portions 2*c* are 1.3 times and 1.5 times as large as those of the main channels 2*a* and the increased channels 2*b*. It is evident from the same figure that the uniform temperature distribution is formed. The measured water velocities $v_8$ and $v_9$ are 7 m/sec while the measured water velocity $v_{10}$ is 7.1 m/sec, which respectively keep the sufficient flowing speed.

In view of the various experimental results, the widths of the branching portions 2*c* and the branch channels 2*d* are suitable to be one to three times (preferably to be 1.5 times) as large as those of the main channels and the increased channels though they depend on the depth thereof, while the depths of the slits are suitable to be from one to two times (preferably 1.3 times) as large as those of the main channels and the increased channels.

As mentioned above in detail, the present invention solves the problem in the conventional water-cooled copper casting mold that the desired advantage can not be obtained by mere provision of the increased channels provided between the right and left main channels and the branch channels thereto for improving the cooling effect in the bolt fastening region. As a result, according to the present invention, since at least ones of the branch channels and branching portions where the main channels and the branch channels merge with each other have larger sectional areas than those of the main channels and the increased channels, it is possible to prevent the amount of cooling water and the water velocity from reducing, thereby performing the uniform cooling function.

Referring to increasing the sectional area of the channels, if the widths of the branch channels and the branching portions are from one to three times as large as those of the main channels and the increased channels and/or the depths of the branch channels and the branching portions are from one to two times as large as those of the main channels and the increased channels, the above effect is conspicuous since the values thereof are proper.

What is claimed is:

1. A water-cooled copper casting mold comprising a copper plate having slits thereon and a back frame fastened to the copper plate at a bolt fastening region to thereby form cooling channels, said cooling channels comprising main channels, increased channels, branching portions and branch channels, said main channels being provided at opposite sides of said bolt fastening region and said increased channels being provided between said main channels and bolt holes contained in said bolt fastening region, said branching portions being provided at ends of said main channels and in flow communication with said increased channels through said branch channels, at least one of the branching portions and branch channels having a larger cross-sectional area than the cross-sectional areas of said main and increased channels.

2. A water-cooled copper casting mold according to claim 1, wherein the widths of the branch channels and the branching portions are from one to three times as large as those of the main channels and the increased channels and/or the depths of the branch channels and the branching portions are from one to two times as large as those of the main channels and the increased channels.

* * * * *